US010242618B2

(12) United States Patent
Rafailov

(10) Patent No.: US 10,242,618 B2
(45) Date of Patent: Mar. 26, 2019

(54) OLED DRIVER, OLED APPARATUS EQUIPPED WITH THE DRIVER AND METHOD OF THE APPARATUS

(71) Applicant: ThirdEye Gen, Inc, Princeton, NJ (US)

(72) Inventor: Michael K. Rafailov, Vienna, VA (US)

(73) Assignee: THIRDEYE GEN, INC, Princeton, NJ (US)

( * ) Notice: Subject to any disclaimer, the term of this patent is extended or adjusted under 35 U.S.C. 154(b) by 15 days.

(21) Appl. No.: 15/692,127

(22) Filed: Aug. 31, 2017

(65) Prior Publication Data

US 2019/0066579 A1 Feb. 28, 2019

(51) Int. Cl.

| | |
|---|---|
| ***H05B 33/08*** | (2006.01) |
| ***G09G 3/3233*** | (2016.01) |
| ***G09G 5/10*** | (2006.01) |

(52) U.S. Cl.

CPC ..... *G09G 3/3233* (2013.01); *G09G 5/10* (2013.01); *G09G 2310/08* (2013.01); *G09G 2320/045* (2013.01)

(58) Field of Classification Search

CPC ..... H05B 33/08; H05B 33/0896; H03K 3/02; H03K 3/06; H03K 3/26

See application file for complete search history.

(56) References Cited

U.S. PATENT DOCUMENTS

| | | | | |
|---|---|---|---|---|
| 8,384,085 | B2 * | 2/2013 | Kimura | H01L 27/124 257/350 |
| 2007/0252126 | A1 * | 11/2007 | Kawakami | B82Y 10/00 257/2 |
| 2009/0219234 | A1 * | 9/2009 | Yamamoto | G09G 3/3233 345/80 |
| 2012/0146542 | A1 * | 6/2012 | Nerone | H02M 3/156 315/294 |
| 2014/0191683 | A1 * | 7/2014 | Gaines | H05B 33/0812 315/294 |
| 2015/0130372 | A1 * | 5/2015 | Chitta | H02M 1/08 315/307 |

* cited by examiner

*Primary Examiner* — Douglas W Owens
*Assistant Examiner* — Syed M Kaiser
(74) *Attorney, Agent, or Firm* — Meagher Emanuel Laks Goldberg & Liao, LLP

(57) ABSTRACT

An organic light emitting diode (OELD) driver for driving at least one OELD having a transition time. The OLED driver has a power supply coupled to a bias pulse controller and an injection pulse controller. The bias pulse controller is configured to generate a bias pulse output based on the OLED transition time. The injection pulse controller is configured to generate an injection pulse output. A combiner is coupled to the bias pulse output and the injection pulse output. The combiner is configured to generate a combined output to drive the OLED. A system controller may be coupled to at least one of the power supply, bias pulse controller and injection pulse controller to adjust the voltage/current delivered to the OLED to adjust a light level output of the OLED. The OLED driver may include a switch that changes a dwell time of the bias pulse controller output.

22 Claims, 7 Drawing Sheets

OLED DRIVER, OLED APPARATUS EQUIPPED WITH THE DRIVER AND METHOD OF THE APPARATUS

FIELD OF THE INVENTION

The present disclosure generally relates to driving circuitry for driving organic light-emitting diodes (OLEDs) and in more particular pulse driving circuitry for OLEDs based on Meta-stability of transient states.

BACKGROUND

An organic light-emitting diode (OLED) has an emissive electroluminescent layer formed from a film of organic compound that emits light in response to an electric current. From the invention of practical OLEDs in the 80s and early 90s the displays have been attaining greater momentum. First, due to the ability to form small pitch large format multi-color displays as well as easy processing, robustness and inexpensive foundry in comparison with its inorganic counterparts. Second because OLED generally can be made flexible, their fabrication as wells as polymer material are inexpensive and can form high quality display panels that operate without a backlight and display deep black levels. One problem with OLEDs is that they suffer from a relatively low lifetime along with low wall plug efficiency that is typically below 20%. This is at least partially due to the OLEDs long relaxation time. This leads first to waste of carriers because when vacancies in the conduction band are filled, current still brings electrons to the OLED polymer emitting layer but rate of relaxation does not empty potential vacancies leading to light emitting. Electrons go straight from cathode to anode, heating the polymer but do not participating in recombination—that is the source of radiance emittance. And in such a case the efficiency of the OLED drops. This phenomenon also leads to OLED temperature degradation because current running through the material causes heating. Both effects are especially pronounced at high brightness of OLED operations, when the OLED current is high. Improvements in this regard would be desirable.

SUMMARY OF THE INVENTION

An organic light emitting diode (OELD) driver for driving at least one OELD having a transition time is disclosed. The OLED driver has a power supply coupled to a bias pulse controller and an injection pulse controller. The bias pulse controller is configured to generate a bias pulse output based on the OLED transition time. The injection pulse controller is configured to generate an injection pulse output. A combiner is coupled to the bias pulse output and the injection pulse output. The combiner is configured to generate a combined output to drive the OLED. A system controller may be coupled to at least one of the power supply, bias pulse controller and injection pulse controller to adjust the voltage/current delivered to the OLED to adjust a light level output of the OLED. The OLED driver may include a switch that changes a dwell time of the bias pulse controller output.

The OLED has a relaxation time and the bias pulse controller may generate pulses having an on-duration based on the OLED transition time and an off-duration based the OLED relaxation time. The bias pulse controller output may comprise pulses having an on duration between 50 ns and 10 microsecond. The system controller may control a dwell time of the bias pulse output to vary current flowing through the OLED such that the OLED generates a target emittance. The system controller may control a pulse repetition rate to vary current flowing through the OLED such that the OLED generates a target emittance. The system controller may control a pulse current to vary current flowing through the OLED such that the OLED generates a target emittance. The system controller may be configured to change a bias pulse shape to vary current flowing through the OLED such that the OLED generates a target emittance.

A method of driving at least one organic light emitting diode (OELD) having a transition time using an OLED driver is disclosed. The method includes generating a bias pulse output based on the OLED transition time; generating an injection pulse output; generating a combined output based on the bias pulse output and the injection pulse output; and driving the OLED with the combined output. The voltage/current delivered to the OLED may be adjusted to adjust a light level output of the OLED. The dwell time of the bias pulse output may be changed. The OLED has a relaxation time and the bias pulse may have an on duration based on the OLED transition time and an off duration based the OLED relaxation time.

The bias pulse output may comprise pulses having an on duration between 50 ns and 10 microsecond. A dwell time of the bias pulse output may be controlled to vary current flowing through the OLED such that the OLED generates a target emittance. A pulse repetition rate may be controlled to vary current flowing through the OLED such that the OLED generates a target emittance. A pulse current may be controller to vary current flowing through the OLED such that the OLED generates a target emittance. A pulse repetition rate may be controlled while keeping current flowing through the OLED such that the OLED generates a target emittance. A pulse shape may be controlled to vary current flowing through the OLED such that the OLED generates a target emittance. Both pulse current and repetition rate may be controlled simultaneously to vary current flowing through the OLED such that the OLED generates a target emittance. A pulse repetition rate may be controlled with chirping frequency while keeping current flowing through the OLED such that the OLED generates a target emittance.

BRIEF DESCRIPTION OF THE FIGS

To facilitate understanding, identical reference numerals have been used, where possible, to designate identical elements that are common to the figures.

DETAILED DESCRIPTION

As noted above, OLEDs are well suited for use in small pitch large format multi-color displays. However, several challenges have emerged like rapid emitter degradation and short lifetime as well as relatively low wall plug efficiency. The degradation of the OLED device caused by extensive heat deposition at high brightness poses questions as to OLED reliability and service life. Typical OLEDs suffer from low energy efficiency and low service life due to the way the device is powered providing excessive electrons flowing into polymer during radiant emittance process when polymer is already in its transient excited state. This disclosure is directed towards an OLED driver that provides a new mode for power OLED devices to reduce electrons waste, energy deposition in the polymer layer, control heating and the degradation of OLED polymer especially at high brightness mode of operations. As explained in more detail below, semiconductor devices including OLEDS may be operated taking into account the Meta-stability of Semiconductor Transient states. Additional disclosure pertaining to Meta-stability is contained in Rafailov and Zakharova, "*Ultrafast Bandgap Technique: Light-Induced Semicondutor Augmentation*", Proc. SPIE 9083, 2014 and Rafailov, "*Metastability of Transient States*", Proc. SPIE 10193, 2017 both of which are incorporated herein in their entirety.

Meta-Stability of Transient States in Applications to OLED

Figure 1:
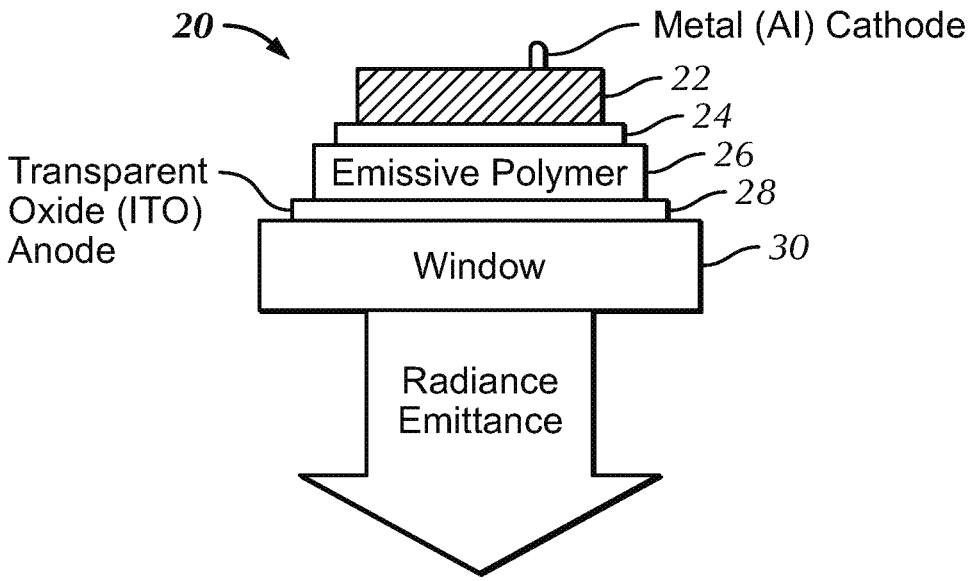
FIG. 1 is a block diagram of a simple OLED structure.

FIG. 1 is a block diagram of a simple OLED structure 20. A typical OLED 20 includes a cathode 22, a transparent anode 28, a conductive layer 24 and an emissive layer 26 disposed between the cathode 22 and anode 28. The device also includes a window 30. When voltage is applied across the cathode 22 and anode 28 and current flows through the OLED, radiation is emitted via the window 30. The emissive layer is made of organic molecules of polymer.

In more detail, when the proper polarity of voltage is applied across the OLED, electrons flow through the device from cathode to anode. Thus, the cathode 22 gives electrons to the emissive layer 26 and the anode 28 gives holes to the emissive layer 26. The electrons and the holes recombine. The recombination causes an emission of radiation. Aluminum is often used for the cathode 22 as it has a low work function which promotes injection of electrons into the polymer layer. It should be understood that other materials with a low work function may be used. Indium tin oxide (ITO) is commonly used as the anode 28 since it is transparent to visible light and has a high work function promoting injection of holes into the polymer layer. It should also be understood that other materials with a high work function may be used.

Figure 2:
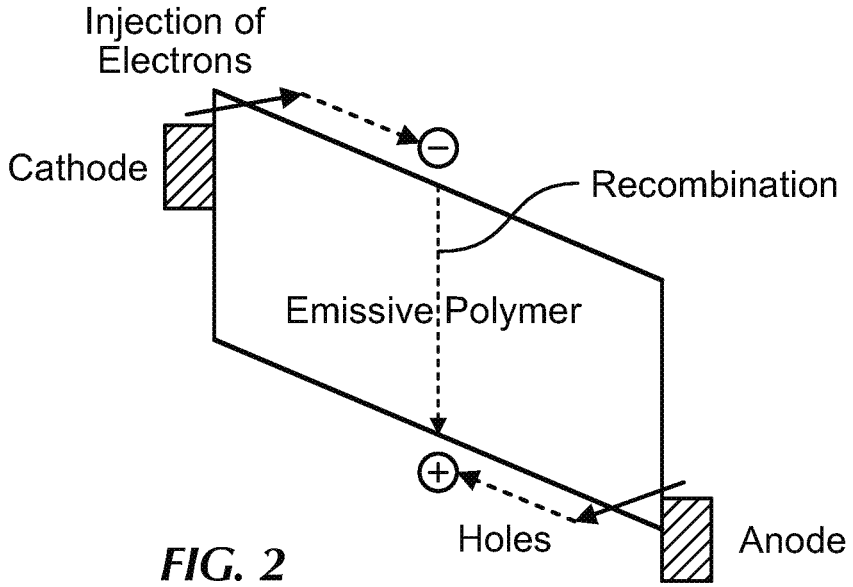
FIG. 2 is a diagram showing the electronic processes that occur in an OLED.

FIG. 2 is a diagram showing the electronic processes that occur in an OLED. The recombination process in OLED is based on two things:

- the motion of positive and negative carriers in the Coulomb field generated by injected carriers; and
- the recombination process itself that happens in bandgap material—that is luminescence related effect.

Motion of carriers or their mobility has voltage and temperature dependence and leads to delay equation:

$$t_d = \frac{d}{\mu F}$$

Where μ is carrier-specifically holes, mobility, d is inter-electrode distance—the distance between cathode and anode surfaces and $$F = \frac{v - v_{bi}}{d}.$$

For example, for a device with ~10 micron thick conduction layer, an injection pulse width of approximately 100 ns would suffice.

Figure 3A:
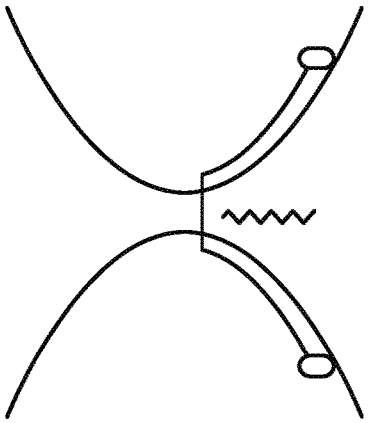
FIGS. 3A and 3B are diagrams showing the pre-recombination process in semiconductors defining a thermal non-equilibrium in excited bandgap material.
Figure 3B:
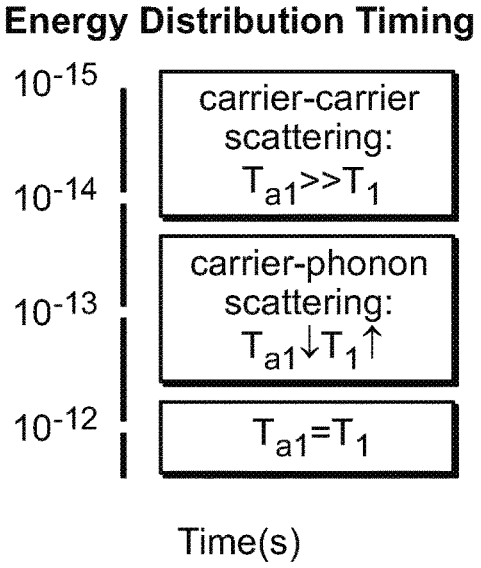
Figure 3C:
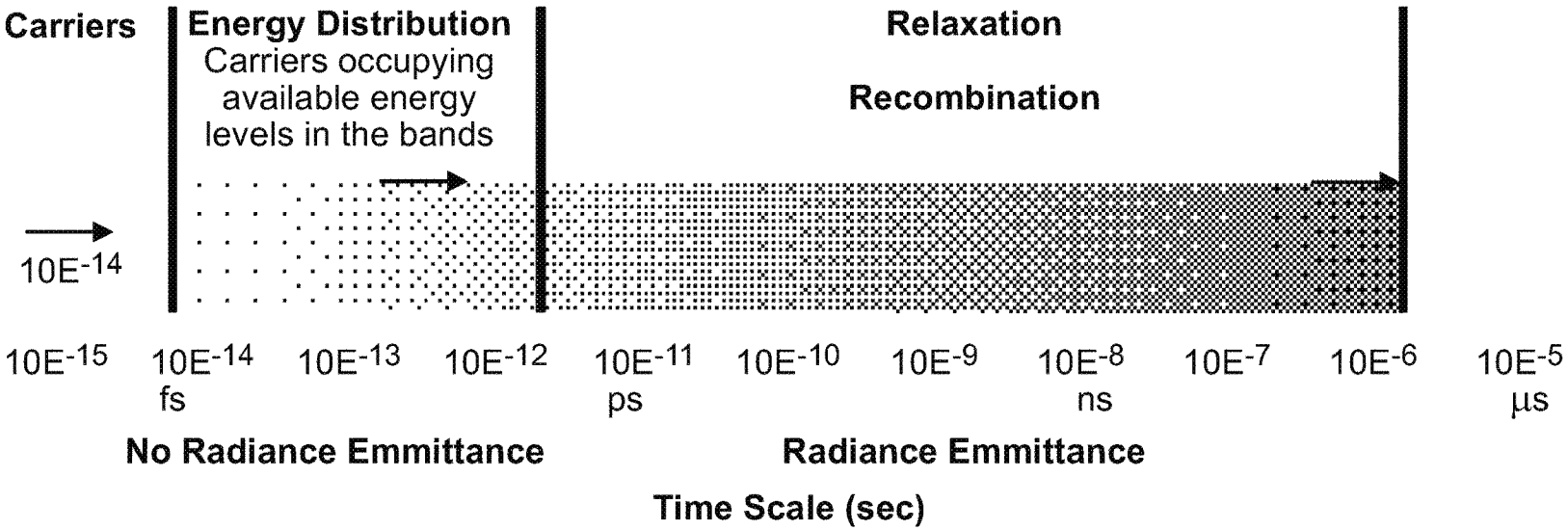
FIG. 3C is a diagram showing the recombination timing the right in semiconductors defining a thermal non-equilibrium in excited bandgap material.

FIGS. 3A and 3B are diagrams showing the pre-recombination process in semiconductors defining a thermal non-equilibrium in excited bandgap material. FIG. 3C is a diagram showing the recombination timing the right in semiconductors defining a thermal non-equilibrium in excited bandgap material. The recombination process the material from non-equilibrium to equilibrium states.

The junction of a direct semiconductor initially has very low free carrier concentration at its thermal equilibrium state. It can be changed either by thermal energy deposit-thermal non-equilibrium state, or an a thermal one. A single act of injection of electrons and holes greatly increase free carrier concentration of both types. Injection brings the direct semiconductor—in this case an OLED polymer, into an a thermal non-equilibrium state. The state lasts for some time-see as shown in FIG. 3C, but eventually starts to decay via the recombination/relaxation processes producing radiation emittance.

Figure 4:
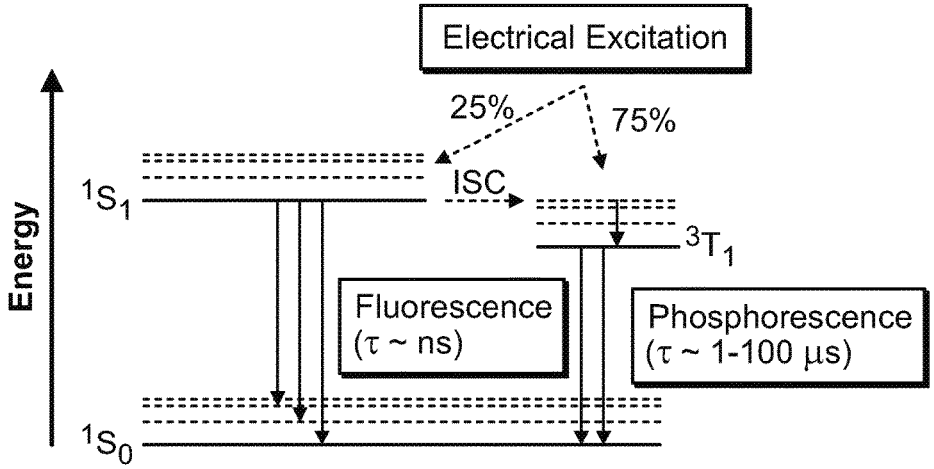
FIG. 4 is a diagram showing the actual timing of radiative processes in an OLED.

OLED irradiance is based on electro-luminescence that is induced by charge carriers, so called injection electro-luminescence, where recombination process may last for up to 100s of μs. Injection luminescence occurs if carriers are injected into a semiconductor which then recombine via radiation-emitting photons. It is important that only concentration of carrier play role in radiance emittance but not their flow that was shown in paper by S Barth, P. Muller, H. Riel, P. F. Seidler and W. Reiss, "*Electron Mobility in tris* (8-*hydroxy-quinoline*) *aluminum thin films determined via transient electroluminescence from single-and multi layered organic light emitting diodes*", Journal of Applied Physics, 89, 3711, 2001, which is incorporated herein in its entirety. FIG. 4 is a diagram showing the actual timing of radiative processes in an OLED.

Some, but not all of the recombination events produce photons. The free carrier concentration decays via recombination giving up photons—in order to maintain energy balance in the material. This returns the polymer back into equilibrium state—unless new portion of free carriers is injected into semiconductor. In a case when constant injection of free carriers via steady DC powering takes place, the non-equilibrium state may last long time. Thermal effects via phonons generated at thermalization time along with current from excessive carriers injected into the layer but not participating in recombination takes its toll by heating the semiconductor and bringing it eventually to a thermal non-equilibrium state that practically results in zero efficiency of the emittance.

The structures and techniques disclosed herein demonstrate that emitting state of OLED can be maintained with relatively short, nano-to micro second scale injection pulses. The pulse repetition rate will depend on cumulative effects of free carrier transport and following recombination. The injection pulses may be arranged in trains and will require much less average power and practically will not have accompanying thermal effects.

Pumping an OLED with short intense injection pulses separated by inter-pulse interval that is comparable with free carrier transition and recombination/relaxation time provides the same luminance but with much lower average power and, therefore, heat deposition into the material can be drastically reduced. In such a case photon emittance will stay the same while power consumption will be reduced proportionally to pulse train duty cycle and with respect to achievable pulse width.

Figure 5:
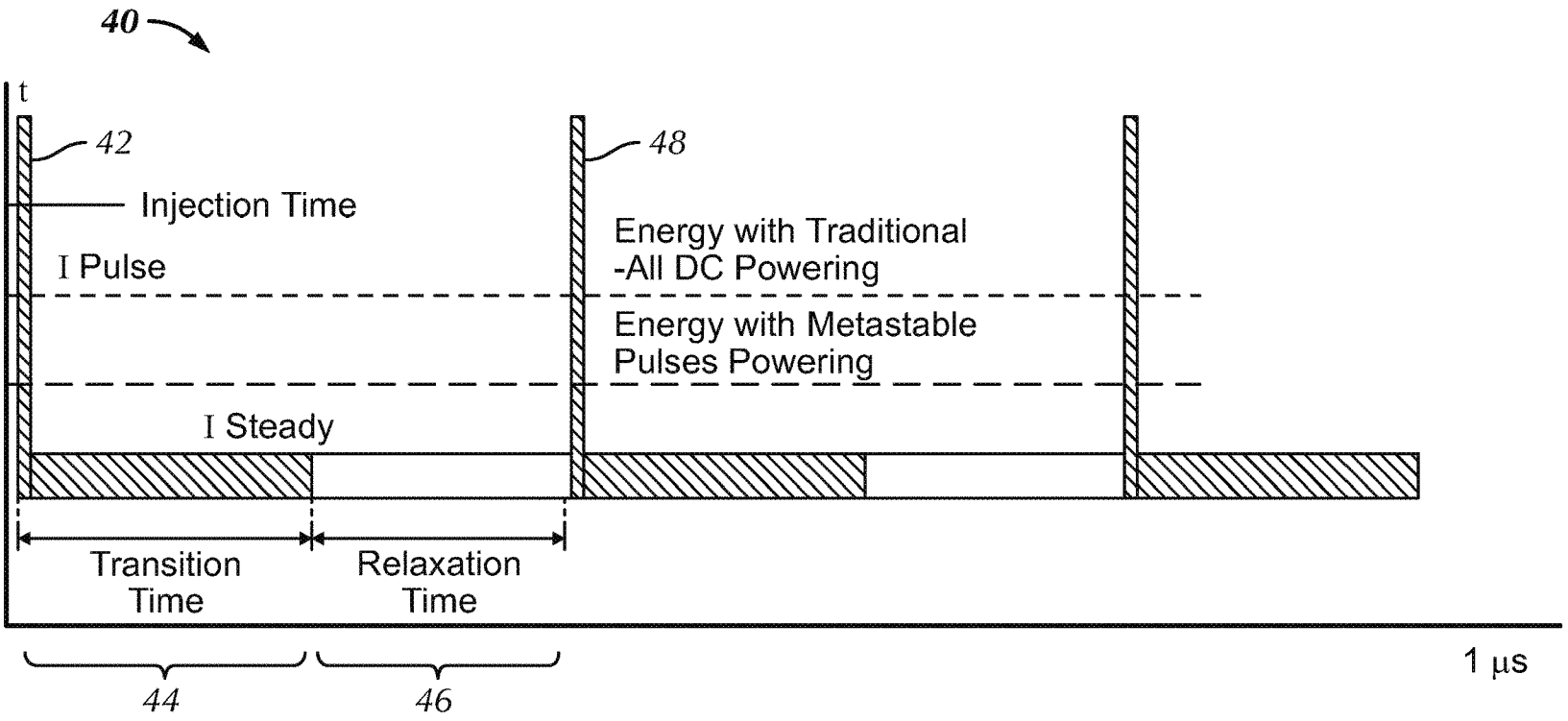
FIG. 5 is a diagram showing Meta-stability of transient states in OLED.

As explained above, injected free carriers need to be brought into the OLED emitting layer via a few other layers. After the injection is finished the specific potential—voltage should be present some time after the injection pulse in order for free carriers to be able to move carrier into the emissive layer. FIG. 5 is a diagram showing Meta-stability of transient states in OLED. The OLED is driven by an injection pulse as shown generally by reference number 42 and a bias pulse (long pulse) shown generally by reference number 44. The injection pulse width is generally along the order of a few ns and will generally depend on the capacitance of the particular OLED being driven. The bias pulse will generally have a pulse width that depends on the transition time of the particular OLED being driven. In general the bias pulse 46 will be zero for a time period relating to the relaxation time of the particular OLED being driven. This cycle then repeats with another injection pulse 48 following the relaxation time as shown in FIG. 5. In some embodiments, the bias pulse may continue through the relaxation time until the next injection pulse however additional power consumption will occur when operating in this mode.

OLED: Power Efficiency in Short Pulse Mode

Figure 6:
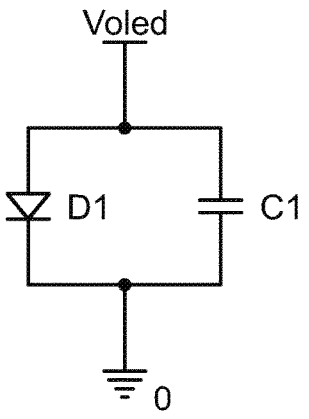
FIG. 6 is a diagram showing a circuit formed by embedded capacitance represented by capacitor $C_1$.

It is possible to reduce the amount of power consumed by the OLED using a metastable approach but concerns exist about the additional power required during switching due to capacitance that is embedded into any diode and formed in OLED particularly between the ITO and cathode. FIG. 6 is a diagram showing a circuit formed by embedded capacitance represented by capacitor $C_1$. The energy that is required to charge that capacitor during switching is one of the primary concerns.

Figure 7:
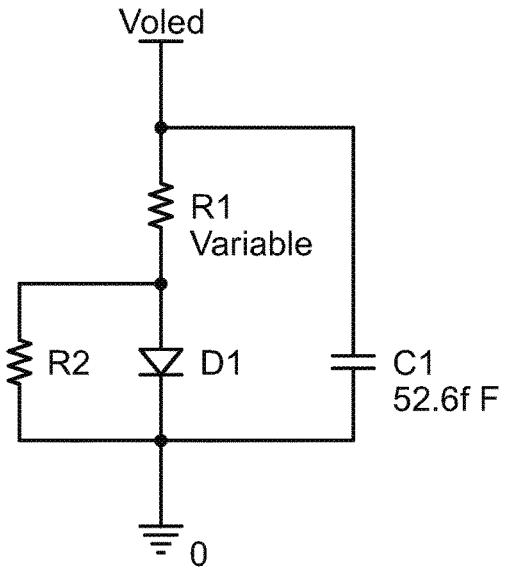
FIG. 7 is an OLED pixel model for spice simulations.

FIG. 7 is an OLED pixel model for spice simulations. Additional details of this spice model may be obtained from Zhang Zhensong, Du Huan, Luo Jiajun, Han Zhengsheng; and Zhao Yi, *A new OLED SPICE model for pixel circuit simulation in LLED-on-silicon microdisplay design*," Journal of Semicondcutors, vol. 33, no. 7, p. 6, 2012 which is incorporated herein in its entirety. A Capacitance of 25 nF/cm$^2$ has been assumed and with pixel size of 14.5 μm$^2$ corresponding with 3.8 μm side size of square pixel, that is comparable with eMagin OLED array pixel size (see eMagin, Enhanced Ultra High-Brightness Full Color OLED Display (EUHB), Prime contract W909MY-12-D-0005, Subcontract WEBS-3000100G-14DD-SC1, Phase II, February 5, Hopewell Junction, N Y, 2016, which is also incorporated herein in its entirety). This yields 52.6femto-Farades (fF) to use in the model.

For the meta-stabile state we have two components of powering—see FIG. 6:

long pulse current flowing through the diode; and a much larger but short duration current pulse injecting electrons into a diode.

For our simulation we will use a current source, then look at the energy delivered to the OLED pixel model and compare it to our baseline that is DC powering mode with no pulses.

The long pulse current, peak current, and timing are all subjects to simulation. For Metastable simulations two sets of data are used based on R. M. A. Dawson, Z. Shen, D. A. Furst, S. Connor, J. Hsu, M. G. Kane, R. G. Stewart, A. Ipri Sarnoff Corporation, Princeton, N.J., U.S.A. C. N. King, P. J. Green, R. T. Flegal, S. Pearson, W. A. Barrow, E. Dickey, K. Ping, S. Robinson. Planar America, Beaverton, Oreg., U.S.A. C. W. Tang, S. Van Slyke, F. Chen, J. Shi, *The Impact of the Transient Response of Organic Light Emitting Diodes on the Design of Active Matric OLED Displays*, Electron Devices Meeting, 1998., Princeton, N.J., which is also incorporated by reference herein and also based on I-V data extracted from the eMagin report.

Figure 8:
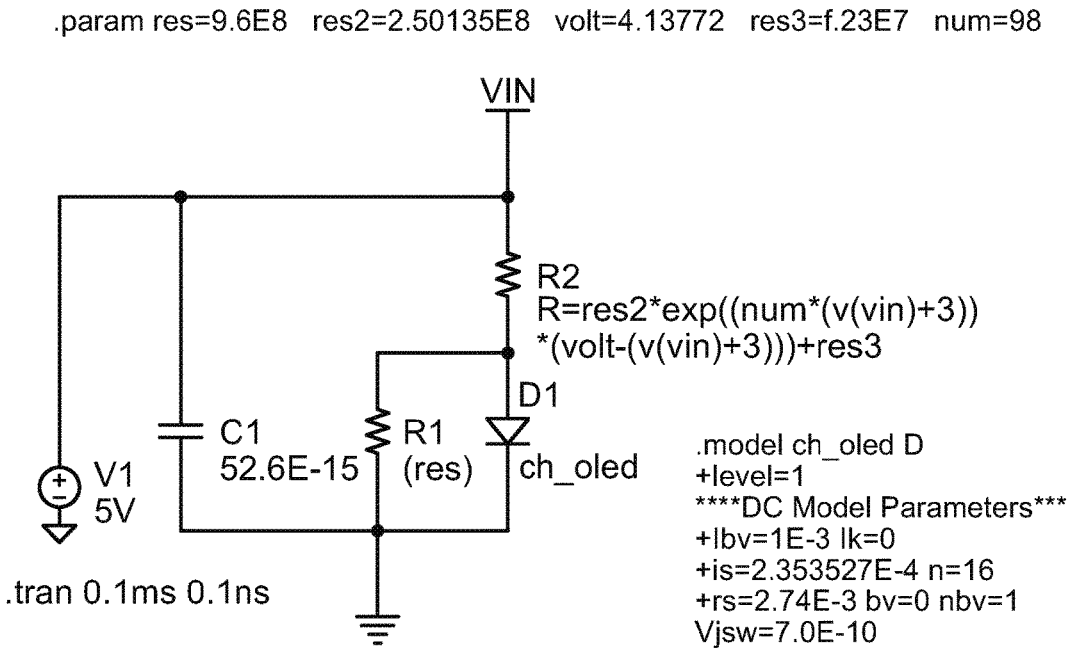
FIG. 8 is a diagram of a baseline model with DC powering.

FIG. 8 is a diagram of a baseline model with DC powering. Consider a baseline DC powering of an OLED. The current consumed in steady state by modeled OLED is about 406.45 nA with a continuous power of around 2 uW, and the energy consumed for 1 ms (1 kHz frame rate) is approximately 2.03 nJ as shown in Table I below:

TABLE I baseline model - DC Powering

| | nJ | voltage | current |
|---|---|---|---|
| Baseline model for 1 ms | 2.0323 nJ | 5 V | 406 nA |

This baseline will be used to compare to the meta-stable approach.

Steady-state current assumed to be 200 nA or roughly half the baseline current from above, and injected pulse of 2000 nA pulse of varying widths every 100 us.

Results for several simulation runs are presented in Table II below:

t-on is pulse width—the on time of the pulse or the amount of time it spends at 2000 nA;

pulse repetition rate is 10 kHz;

cap contribution is what capacitor draws back;

baseline energy for OLED powered with DC current at 5 v is 2.032 nJ;

TABLE II

Meta-stable Simulation Results

| Current (nA) | Current (nA) | t-on (us) | t-period (us) | Energy (nJ) | Cap contribution (nJ) | Cap % |
|---|---|---|---|---|---|---|
| 200 | 2000 | 0.05 | 100 | 0.497 | 5.09E−05 | 1.02E−02 |
| 200 | 2000 | 0.1 | 100 | 0.504 | 6.50E−05 | 1.29E−02 |
| 200 | 2000 | 1 | 100 | 0.78 | 6.20E−05 | 7.95E−03 |
| 200 | 2000 | 2.5 | 100 | 1.46 | 8.70E−05 | 5.96E−03 |
| 200 | 2000 | 5 | 100 | 2.675 | 3.50E−05 | 1.31E−03 |
| 200 | 2000 | 7.5 | 100 | 3.8 | 1.90E−05 | 5.00E−04 |
| 200 | 2000 | 10 | 100 | 5.11 | 1.80E−05 | 3.52E−04 |

The first interesting thing to look at is the contribution of the capacitor is very small compared to the total energy. If you look at the micro-second level pulses you can see that there's a point where the pulse width pushes the energy required to drive the OLED past the baseline energy of 2.0323 nJ. If you look at the ns level pulses you can see as you shrink the pulse width you approach the steady state energy which for 200 nA was 492 pJ.

For meta-stability drive we have a bias long pulse current flowing through the diode keeping the electrons moving into emitting layer. With respect to electron mobility in OLED materials and their thickness, the long pulse bias duration is between 50 ns and 10 microsecond depends on the conductive layer. Commonly used Alq3 thickness is between 50 nm and 1 micrometer. Then periodically e.g., every 100 us, we inject one or more much larger current pulse(s) (injection pulse) and then return to long pulse steady state (bias pulse).

Injection pulse current may vary depending on target emittance from bias pulse current to maximum radiant emittance current. Injection pulse repetition rate may vary from time of OLED relaxation time, e.g., hundreds of microsecond to time of fluorescence recombination, e.g., hundreds of nano-seconds. Injection pulse repetition frequency can chirp, follow a non-linear pattern of recombination process pattern in a way that the interpulse interval changes from pulse to pulse, e.g., starting from hundred nano-second and ending in micro-second interval For our modeling we use a current source, then look at the energy delivered to the OLED pixel model and compare it to our baseline. The steady state current, peak current, and timing are all subjects of the study we are proposing so for this simulation we'll use an example. We'll take 10 nA as our steady state current, or roughly half the baseline current from the first simulation, and we'll inject ten times that or a 100 nA pulse of varying pulse dwell time every 100 us.

The calculated energy includes the baseline energy plus 10 pulses worth of energy, so basically all the energy used over a 1 ms period. Keep in mind the baseline energy used to power the OLED at 5V was 100 pJ. The results of the simulation is in Table III below.

TABLE III

Simulation Results

| Hold Current (nA) | Peak Current (nA) | t-on | t-per (us) | En-gy | Cap contribution |
|---|---|---|---|---|---|
| 10 | 100 | 50 ns | 100 | 47.68 pJ | 9.41 fJ |
| 10 | 100 | 100 ns | 100 | 47.92 pJ | 12.78 fJ |
| 10 | 100 | 1 us | 100 | 52.43 pJ | 4.58 fJ |
| 10 | 100 | 2.5 us | 100 | 59.9 pJ | 13.18 fJ |
| 10 | 100 | 5 us | 100 | 72.33 pJ | 7.38 fJ |
| 10 | 100 | 7.5 us | 100 | 84.77 pJ | 8.15 fJ |
| 10 | 100 | 10 us | 100 | 97.21 pJ | 10.15 fJ |

For this simulation you can see that with at t-on of 10 us we are approaching the 100 pJ consumed by the baseline but at smaller pulse widths we're seeing close to half of the energy being consumed.

Figure 9:
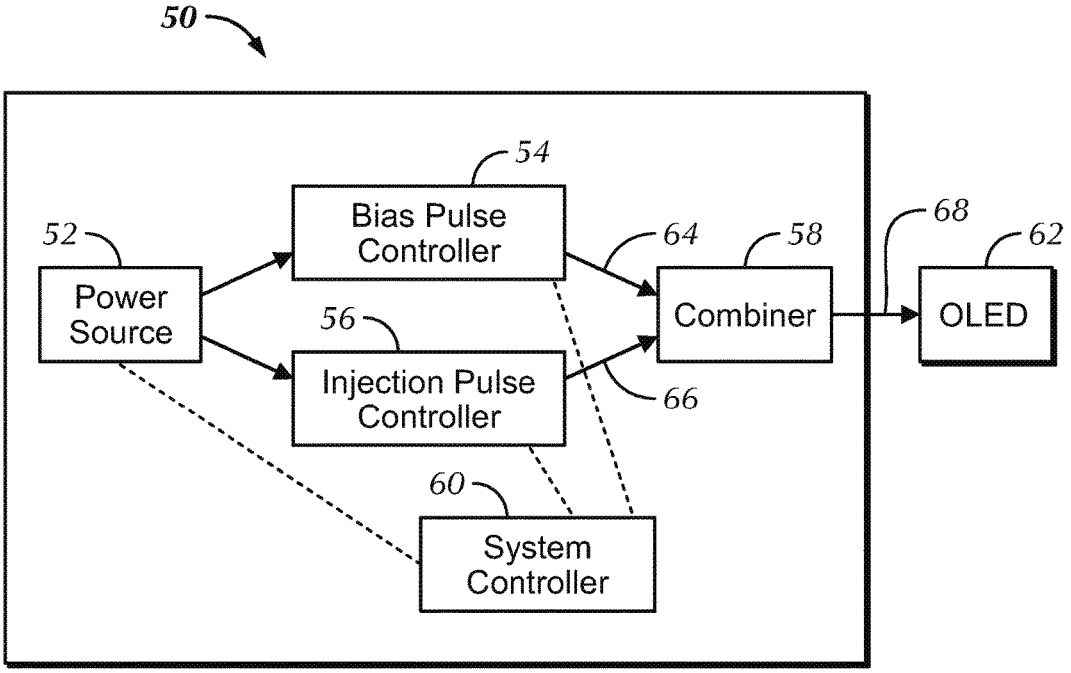
FIG. 9 is a block diagram of an OLED driver configured for meta-stable operation.

FIG. 9 is a block diagram of an OLED driver 50 configured for meta-stable operation. The OLED driver includes a power supply 52 e.g., a voltage source, coupled to a bias pulse controller 54 and an injection pulse controller 56. The bias pulse controller 54 is configured to generate a bias controller output 64 having a bias pulse output. The injection pulse controller is configured to generate a pulse controller output 66 having a pulsed voltage output. The bias pulse controller output 64 and injection pulse controller output 66 are coupled to a combiner that generates a combined output 68 that is used to drive an OLED 62. The combined output 68 combines the bias pulse voltage and the injection pulse voltage output. A system controller 60 is coupled to at least one of the power supply, DC bias controller and pulse controller to adjust the voltage/current delivered to the OLED to adjust a light level output of the OLED.

The bias pulse controller 54 includes a switch that changes the dwell time of the bias pulse controller output 64. The bias pulses may have a duration between the fluorescence and phosphorescence OLED relaxation times, e.g., between 1 ns and 1 microsecond for the pulsed electric current flowing through the OLED. Based on the value of the electric current, the system controller 60 may generally control the dwell time of the bias pulse controller output 64 so that the value of the electric current flowing through the OLED generates a target emittance of the element. The system controller may also control the pulse repetition rate of the bias pulse controller output 64 to vary current flowing through the OLED such that the OLED generates a target emittance. The system controller may control the pulse current to vary current flowing through the OLED such that the OLED generates a target emittance. The pulse controller 56 may be configured to change pulse shape at the bias pulse controller output 64. The system controller 60 may be configured to control the pulse shape to vary current flowing through the OLED such that the OLED generates a target emittance.

It should be understood that many variations are possible based on the disclosure herein. Although features and elements are described above in particular combinations, each feature or element can be used alone without the other features and elements or in various combinations with or without other features and elements.

What is claimed is:

1. An organic light emitting diode (OELD) driver for driving at least one OELD having a transition time, the OLED driver comprising:

a power supply coupled to a bias pulse controller and an injection pulse controller, the bias pulse controller is configured to generate a bias pulse output based on the OLED transition time, the injection pulse controller is configured to generate an injection pulse output; and a combiner coupled to the bias pulse output and the injection pulse output, the combiner being configured to generates a combined output to drive the OLED.

2. The OLED driver of claim 1 further comprising a system controller coupled to at least one of the power supply, bias pulse controller and injection pulse controller to adjust the voltage/current delivered to the OLED to adjust a light level output of the OLED.

3. The OLED driver of claim 1, further comprising a switch that changes a dwell time of the bias pulse controller output.

4. The OLED driver of claim 3, wherein the OLED has a relaxation time and the bias pulse controller generates pulses having an on-duration based on the OLED transition time and an off-duration based the OLED relaxation time.

5. The OLED driver of claim 3, wherein the bias pulse controller output comprises pulses having an on duration between 50 ns and 10 microsecond.

6. The OLED driver of claim 2, wherein the system controller controls a dwell time of the bias pulse output to vary current flowing through the OLED such that the OLED generates a target emittance.

7. The OLED driver of claim 2 wherein the system controller controls a pulse repetition rate to vary current flowing through the OLED such that the OLED generates a target emittance.

8. The OLED driver of claim 2 wherein the system controller controls a pulse current to vary current flowing through the OLED such that the OLED generates a target emittance.

9. The OLED driver of claim 2 wherein the system controller is configured to change a bias pulse shape to vary current flowing through the OLED such that the OLED generates a target emittance.

10. The OLED driver of claim 1 further comprising at least one OLED.

11. A method of driving at least one organic light emitting diode (OELD) having a transition time using an OLED driver, the method comprising:

generating a bias pulse output based on the OLED transition time;

generating an injection pulse output;

generating a combined output based on the bias pulse output and the injection pulse output; and driving the OLED with the combined output.

12. The method of claim 11 comprising adjusting the voltage/current delivered to the OLED to adjust a light level output of the OLED.

13. The method claim 11, further comprising changing a dwell time of the bias pulse output.

14. The method claim 13, wherein the OLED has a relaxation time and the bias pulse has an on duration based on the OLED transition time and an off duration based the OLED relaxation time.

15. The method claim 13, wherein the bias pulse output comprises pulses having an on duration between 50 ns and 10 microsecond.

16. The method claim 12, further comprising controlling a dwell time of the bias pulse output to vary current flowing through the OLED such that the OLED generates a target emittance.

17. The method claim 12, further comprising controlling a pulse repetition rate to vary current flowing through the OLED such that the OLED generates a target emittance.

18. The method claim 12, further comprising controlling a pulse current to vary current flowing through the OLED such that the OLED generates a target emittance.

19. The method claim 12, further comprising controlling a pulse repetition rate while keeping current flowing through the OLED such that the OLED generates a target emittance.

20. The method claim 12, further comprising controlling a pulse shape to vary current flowing through the OLED such that the OLED generates a target emittance.

21. The method claim 12, further comprising controlling both pulse current and repetition rate simultaneously to vary current flowing through the OLED such that the OLED generates a target emittance.

22. The method claim 19 comprising controlling a pulse repetition rate with chirping frequency while keeping current flowing through the OLED such that the OLED generates a target emittance.

* * * * *